United States Patent [19]

Orobin

[11] 4,393,887

[45] Jul. 19, 1983

[54] COLLAPSIBLE TENT FRAME

[76] Inventor: Edwin H. Oribin, K. & K. Factory, Mayne St., Launceston, Tasmania, 7250, Australia

[21] Appl. No.: 273,967

[22] Filed: Jun. 15, 1981

Related U.S. Application Data

[63] Continuation of Ser. No. 66,863, Aug. 15, 1979, abandoned.

[30] Foreign Application Priority Data

Aug. 17, 1978 [AU] Australia ..... PD5520

[51] Int. Cl.[3] ..... A45F 1/16

[52] U.S. Cl. ..... 135/109; 52/645; 52/648

[58] Field of Search ..... 135/3 R, 4 R; 52/645, 52/648

[56] References Cited

U.S. PATENT DOCUMENTS

| | | | |
|---|---|---|---|
| 1,546,222 | 7/1925 | Finlay | 135/4 R X |
| 2,113,118 | 4/1938 | Pyatt | 135/4 R |
| 2,962,034 | 11/1960 | Finlayson | 135/4 R |
| 3,059,658 | 10/1962 | Finlayson | 135/4 R |
| 3,266,503 | 8/1966 | Hoiness et al. | 135/4 R |
| 3,502,091 | 3/1970 | Corbin | 135/4 R |
| 4,069,832 | 1/1978 | Bingham | 135/3 R |

FOREIGN PATENT DOCUMENTS

| | | | |
|---|---|---|---|
| 721247 | 12/1931 | France | 135/4 R |
| 600750 | 12/1959 | Italy | 135/4 R |

*Primary Examiner*—J. Karl Bell

*Attorney, Agent, or Firm*—Charles W. Helzer

[57] ABSTRACT

The invention relates to a collapsible tent frame which may be fabricated to define a triangular, square or polygonal base area and which may be folded from a fully erected position to a fully collapsed position, wherein the total frame structure is reduced to a compact, elongate package suitable for carriage within an appropriate container or satchel.

13 Claims, 3 Drawing Figures

COLLAPSIBLE TENT FRAME

This is a continuation of application Ser. No. 066,863 filed Aug. 15, 1979 now abandoned.

This invention relates to a collapsible frame for use with an enclosure such as a tent or the like.

Collapsible frames of conventional design generally consist of a considerable number of individual parts which are plugged or bolted together when the frame is erected. Frames of this type are generally awkward to assemble and may be rendered useless if an individual part is lost or mislaid. Also, many collapsible frames of known construction can only be erected over soft ground into which poles, pegs etc. must be inserted.

The present invention seeks to overcome the stated disadvantages of the aforementioned prior art by providing a collapsible frame, for use with an enclosure such as a tent, which comprises a unitary structure which may be folded or erected without the use of additional elements, particularly elements requiring soft ground engagement to achieve stability. The present invention further provides a collapsible tent frame which, when fully erected, may be linked together with one or more tent frames of similar construction to form a unitary framework for a tent complex.

According to the broadest aspect, the present invention provides a collapsible tent frame comprising a plurality of elongate members hingedly interconnected at their ends so that the frame may be folded between fully erected and fully collapsed positions, the frame, in said fully collapsed position, defining a compact, elongate assembly and, in said fully erected position, defining a plurality of triangles combining to form wall and ceiling areas, said frame further defining a base area for ground engagement.

A preferred embodiment of the invention will now be described with reference to the accompanying drawings, in which.

Figure 1:
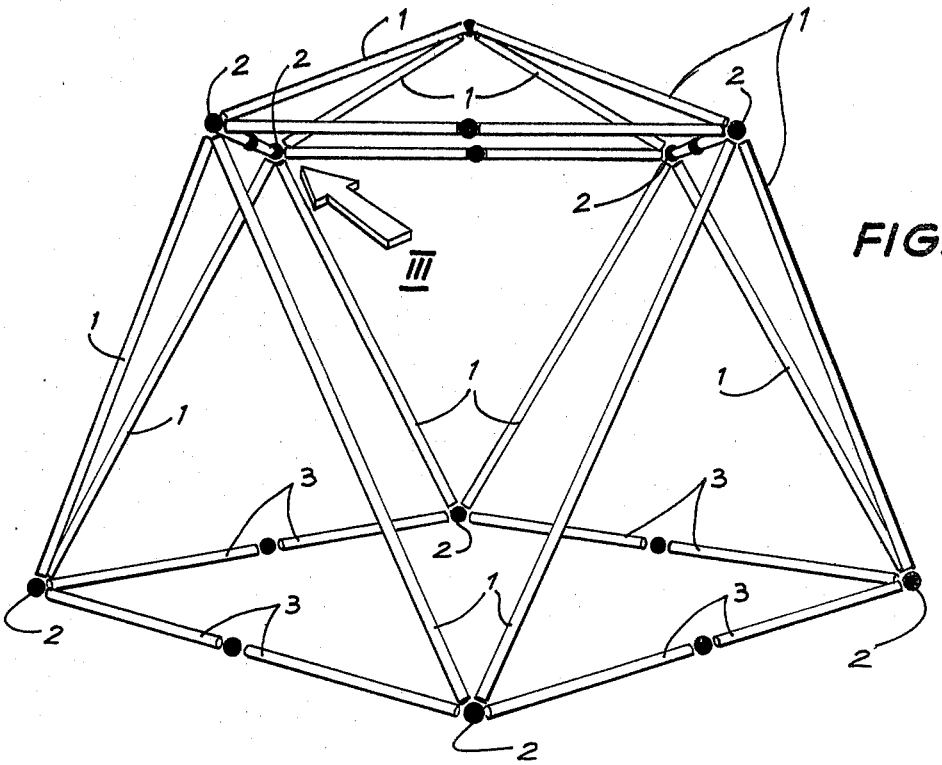
FIG. 1 is a perspective view of a fully erected collapsible tent frame defining a square base area.

Referring firstly to FIG. 1, a collapsible tent frame in accordance with the present invention comprises a plurality of elongate members 1 hingedly interconnected at their ends by vertex hinges 2. The elongate members 1 preferably comprise poles fabricated from aluminium or an alloy thereof. The vertex hinges 2 may be fabricated from either aluminium, an aluminium alloy, a plastics material or any other material suitable for the purpose.

When the tent frame is in the fully erected position shown in FIG. 1, the combination of the elongate members 1 defines a plurality of triangles forming wall and ceiling areas. The base of the tent frame is defined by base members 3 which may comprise either sections of pole similar to that from which elongate members 1 are fabricated with a hinged connection substantially halfway along the length thereof, or sections of flexible cord. In the case of the preferred construction shown in FIG. 1, the elongate members 1 which lie along a plane parallel to base members 3 also have a hinged connection substantially halfway along the length thereof. Although the tent frame shown in FIG. 1 defines a square base area, collapsible tent frames in accordance with the present invention may also be constructed to define triangular or polygonal base areas. Generally, in the case of constructions defining square or polygonal base areas, it is necessary to provide a hinged connection substantially halfway along the length of each of the elongate members lying along the plane parallel to the base members and, except where the base members are fabricated from a flexible material, also substantially halfway along the length of each of the base members.

When the collapsible tent frame is fully erected, the ceiling and wall areas of the frame are defined by a plurality of triangles formed by elongate members 1. The total structure may then be covered with a suitable tent material. The total structure is self-bracing in the fully erected position and does not require any external locking means. A further advantage of the present invention is that any one of the defined triangular areas including a base member may be linked with a corresponding triangular area of another frame structure in accordance with the invention to establish a tent complex. If desired, a simple link means obvious to persons skilled in the art may be employed to establish a stable fixing between linked frame structures.

Figure 2:
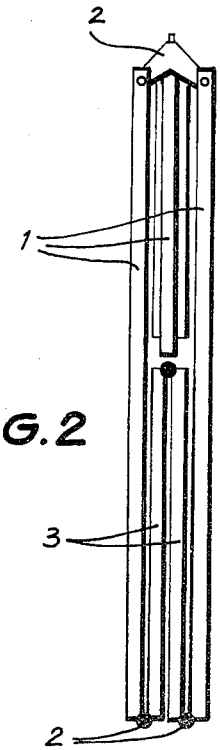
FIG. 2 is a perspective view of the collapsible tent frame shown in FIG. 1 in its fully collapsed position.

Referring now to FIG. 2 of the accompanying drawings, the collapsible tent frame forms a compact elongate bundle when folded from the fully erected position shown in FIG. 1. The frame, in its fully folded position, may then be placed into a suitable carrier or satchel for purposes of portability.

Figure 3:
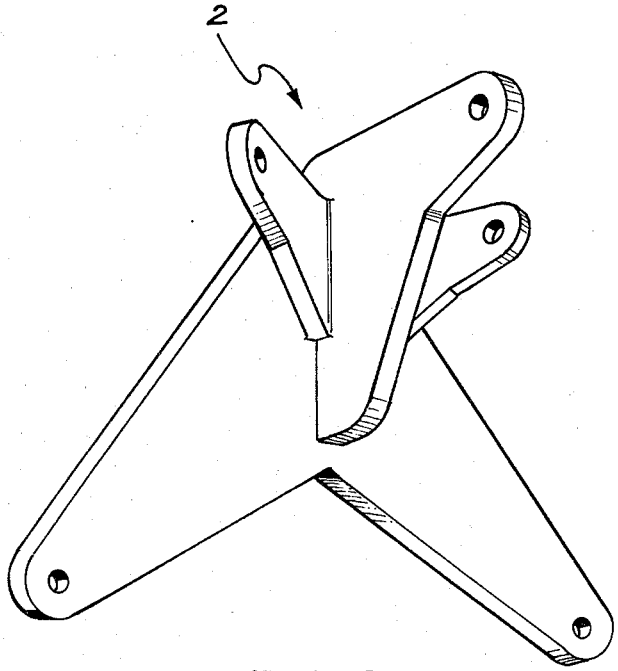
FIG. 3 is a detailed view of a vertex hinge denoted by the numeral 2 in FIG. 1.

Refering now to FIG. 3 of the accompanying drawings, each vertex hinge, denoted by the numeral 2 in FIG. 1, comprises basically a plate to which the appropriate ends of an appropriate number of elongate members are pivotally connected. Pivotal connection may be established by means of a simple pin-type pivot, as shown in FIG. 3. The vertex hinge may be fabricated from either aluminium, an alloy thereof or any other material suitable for the purpose. Preferably, however, the vertex hinges employed with the present invention are fabricated from an unbreakable plastics material, thus providing for ease of manufacture through a moulding process and the absence of any corrosion occuring in the hinged assembly. A similar hinging principal is preferably employed in fabricating the hinged connections intermediate along the lengths of the base members and the elongate members lying in a plane parallel to the base members.

Depending upon the slope of each of the triangular segments defining the sealing area, it may be necessary to incorporate into the elongate member structure a means of obtaining a measure of resilience to enable the total frame structure to be folded towards the collapsed position. One means of obtaining this resilience is to include a hinged interconnection substantially midway along the length of one of the elongate members extending away from the central vertex of the sealing area; that is one of the elongate members defining the sealing area and not parallel to the plane of the base area. Another means of obtaining the required resilience in the sealing structure is to spring load at least one of the hinged interconnections along the length of the elongate members defining the sealing area and parallel to the plane of the base area. This would enable at least one of the elongate members defining the sealing area and parallel to the plane of the base area to be expandible against spring tension and thus enable the total sealing area to be brought down through a plane parallel to the base area to a position where the total structure may be fully folded. Obviously, all vertex hinges and intermediate hinges may be spring loaded in this way to additionally facilitate folding of the tent frame.

The present invention thus provides a collapsible tent frame which is foldable into a compact, elongate bundle without the necessity for any dismantling of parts. Furthermore, the tent frame of the present invention is readily adaptable to be linked with other tent frames constructed in accordance with the invention to form a tent complex. The invention further provides for a collapsible tent frame to be constructed to a wide variety of size and shape requirements.

The foregoing is a statement of only one preferred embodiment of the present invention and, with reference to the drawings, depicts only a tent frame constructed to define a square base area. As mentioned, however, collapsible tent frames in accordance with the present invention may be constructed to define either triangular, square or polygonal base areas. Furthermore, the vertex hinges described in conjunction with the preferred embodiment of the invention may be replaced with any form of hinge assembly suitable for use with the invention and which may be easily fabricated from common knowledge by a person skilled in the art. Accordingly, the foregoing preferred embodiment should not be regarded as restrictive over the numerous manifestations if the most basic concept of the invention herein disclosed.

I claim:

1. A rigid self supporting collapsible tent frame comprised of triangular roof and wall frame sections formed of elongate frame members hingedly interconnected at their ends to form a unitary structure in both the erected and collapsed state, the adjacent triangular roof frame sections of said collapsible tent having a common elongate roof frame member and alternate ones of the triangular wall frame sections having an elongate member common with a triangular roof frame section, said roof frame sections having a common apex in both the erected and collapsed state, the elongate members common to the wall and roof frame sections being hingedly connected at the ends thereof to define the ceiling area of the tent, said common wall and roof frame section members being comprised of at least two parts connected by means to provide a flexible joint that is spring loaded and allows both expansion and contraction at a point therealong remote from the points of connection of other roof frame section members connected thereto, the remaining alternate ones of the triangular wall frame sections having two common elongate frame members with the first mentioned alternate triangular wall frame sections and being inversely arranged relative thereto to define the base area and a plurality of free corners of the tent, the elongate frame members of the remaining alternate triangular wall frame sections defining the base area and the plurality of free corners of the tent being comprised by means to provide a flexible joint at an intermediate point therealong remote from the points of connection of the first mentioned alternate triangular wall frame sections thereto.

2. A collapsible tent frame as claimed in claim 1 wherein said base area is square.

3. A collapsible tent frame as claimed in claim 1 wherein said base area is polygonal.

4. A collapsible tent frame as claimed in claim 1 wherein the total tent wall area is twice the area encompassed by said first mentioned alternate triangular wall frame sections, and the total tent ceiling area is equal to the area encompassed by said ceiling frame sections.

5. A collapsible tent frame as claimed in claim 1 wherein the free corners of the remaining alternate inversely arranged triangular wall frame sections are interconnected by rope.

6. A collapsible tent frame as claimed in claim 1 wherein the free corners of the remaining alternate inversely arranged triangular wall frame sections are interconnected by rigid elongate members pivotally connected to said corners and each being bendable at the center thereof to facilitate collapsing the tent frame and conforming the base of the tent to the topography of the ground on which it is erected.

7. A collapsible tent frame as claimed in claim 1 wherein said means to provide a flexible joint comprises a spring.

8. A collapsible tent frame as claimed in claim 1 wherein the frame in the fully erected position can be linked to the frame of another tent frame to form a tent complex.

9. A collapsible tent frame as claimed in claim 6 wherein the hinged interconnections at the ends of said elongate members comprise pin hinges fabricated from a plastics material.

10. The collapsible tent frame as claimed in claim 1 further including a tent cover maintained in place on the frame in both the erected and collapsed state and wherein the tent can be erected or collapsed by a single person with the tent cover in place.

11. The tent frame and cover as claimed in claim 10 wherein the tent when erected is fully self supporting and does not require guy wires, stays or other similar external supporting fixtures for stability.

12. The collapsible tent frame as claimed in claim 6 further including a tent cover maintained in place on the frame in both the erected and collapsed state and wherein the tent can be erected or collapsed by a single person with the tent cover in place.

13. The tent frame and cover as claimed in claim 12 wherein the tent when erected is fully self supporting and does not require guy wires, stays or other similar external supporting fixtures for stability.

* * * * *